United States Patent [19]

Bush

[11] 4,335,824

[45] Jun. 22, 1982

[54] CHILD-RESISTANT TAMPER INDICATING PACKAGE

[75] Inventor: Randall G. Bush, Evansville, Ind.

[73] Assignee: Sunbeam Plastics Corporation, Evansville, Ind.

[21] Appl. No.: 241,735

[22] Filed: Mar. 9, 1981

[51] Int. Cl.[3] ..... G65D 55/02

[52] U.S. Cl. ..... 215/224; 215/256; 215/317

[58] Field of Search ..... 215/215, 224, 225, 256, 215/317; 220/270, 306

[56] References Cited

U.S. PATENT DOCUMENTS

| | | | |
|---|---|---|---|
| 3,986,626 | 10/1976 | Montgomery | 215/224 X |
| 4,071,156 | 1/1978 | Lowe | 215/224 |
| 4,278,178 | 7/1981 | Geiser | 215/215 |

*Primary Examiner*—George T. Hall

*Attorney, Agent, or Firm*—Fisher, Gerhardt, Crampton & Groh

[57] ABSTRACT

A child-resistant, tamper indicating package includes a container having a body portion with a tubular neck and a closure for the neck which is removable and reclosable. The container has a shoulder at the juncture of the body and the neck and the neck has a radially outwardly extending annular rib spaced from the shoulder. The rib has opposed upper and lower converging surfaces such that the included angle at which the lower surface intersects the tubular neck is greater than the included angle at which the upper surface intersects the tubular neck. The closure has a disc-shaped top and a flexible annular skirt the lower edge of which is formed with an inwardly directed flange. The inside diameter of the flange is less than the outside diameter of the rib on the neck so that the flange engages the upper surface of the rib to flex the skirt radially outwardly during downward movement of the closure on the neck until the flange snaps beneath the neck rib to hold the closure in sealing engagement with the neck. The greater lower angular surface prevents a manual removal of the closure without a tool.

12 Claims, 10 Drawing Figures

CHILD-RESISTANT TAMPER INDICATING PACKAGE

This invention relates to child-resistant closure and container packages and more particularly to such packages which are tamper indicating.

A large variety of closure and container combinations have been devised which are child-resistant. Some of such packages also have been provided which are tamper indicating making it possible to observe whether or not the package has been opened. Unfortunately, such packages often are not reclosable or are relatively complex in the coaction between the closure and the container which makes it difficult or expensive to manufacture and to use.

It is an object of the invention to provide a child-resistant tamper indicating package which is reclosable when the container holds more product than would be used at a single application.

Still another object of the invention is to provide a child-resistant, tamper indicating package in which the appearance of the package, when compared with other packages of the same kind, makes it apparent that it has been tampered with.

The objects of the invention are accomplished by a package in which a hollow container has a body portion and a tubular neck forming the opening communicating with the interior of the container. The neck and body form an annular shoulder and the neck has an annular rib on its exterior spaced from the shoulder. The rib has upper and lower surfaces disposed at an angle to the neck which coact with a lip formed on the skirt of the closure such that the lip is cammed over the rib to a closed position so that the rib resists opening movement except by use of a tool. The bottom of the skirt of the closure is spaced from the shoulder for the purpose of receiving a tool but a ring is formed integrally with the closure and is in close proximity to the shoulder to obstruct entry of the tool until the ring is removed. In one embodiment of the invention the ring is completely removable and in another embodiment, only a segment of the ring is removable and in each instance the removal of the entire ring or the ring portion makes it apparent that the package has been tampered with, that is, it has been placed in a condition to be opened and perhaps has been opened. Both embodiments of the invention permit reclosing of the package after all or a portion of the contents have been disposed.

These and other objects of the invention will be apparent from the following description of preferred embodiments and from the drawings in which.

Figure 1:
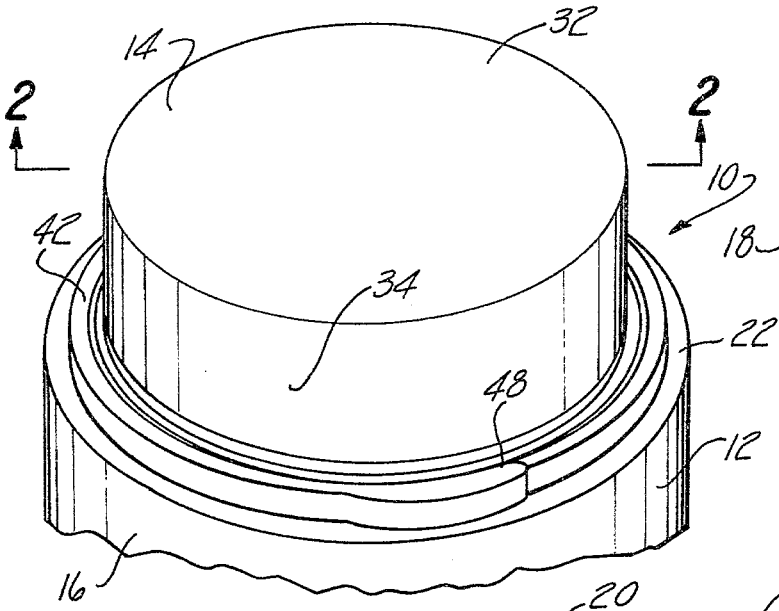
FIG. 1 is a perspective view of the upper portion of a child-resistant tamper indicating package embodying the invention.

The upper end of a package embodying the invention is designated generally at 10 and includes a container 12 and a closure 14.

The container 12 can be generally cylindrical with a body 16, only the upper portion of which is shown, and a neck 18 of smaller diameter than the body 16. The neck 18 has an upper lip 20 which defines an opening to the interior of the hollow container 12. The neck 18 is of smaller diameter than the body 16 and forms a shelf 22 from which the neck 18 extends.

Figure 2:
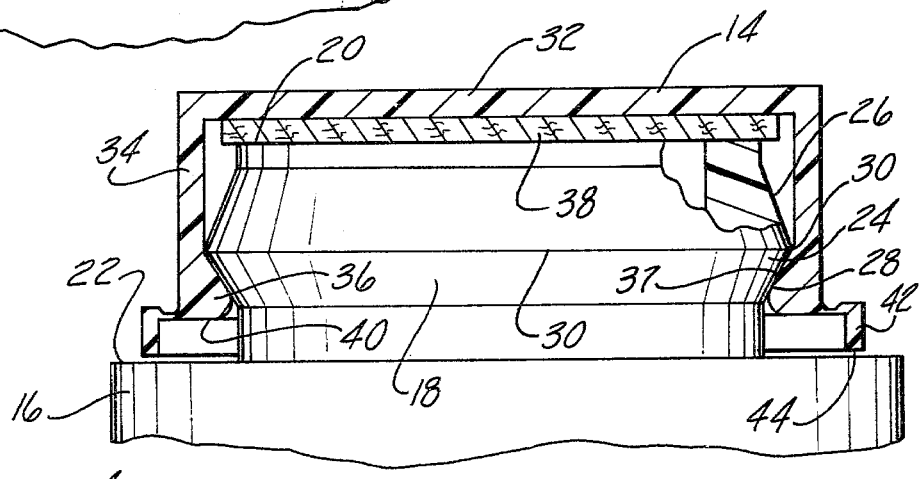
FIG. 2 is a corss-sectional view of the arrangement seen in FIG. 1 showing one form of seal cooperating with the neck of a container.
Figure 4:
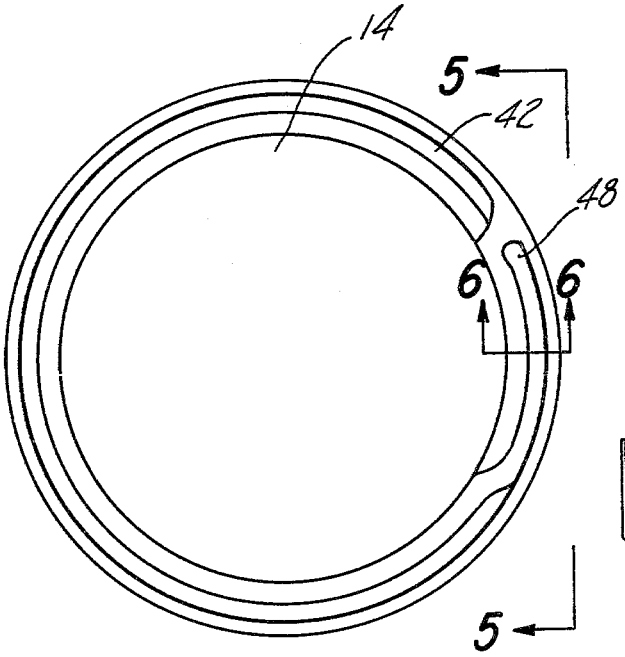
FIG. 4 is a top plan view of the closure seen in FIG. 2.
Figure 5:
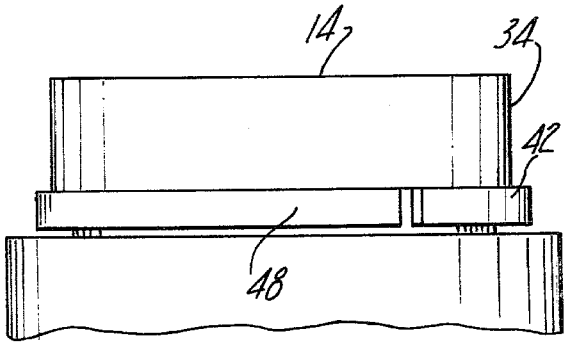
FIG. 5 is a view taken generally on line 5—5 in FIG. 4.
Figure 6:
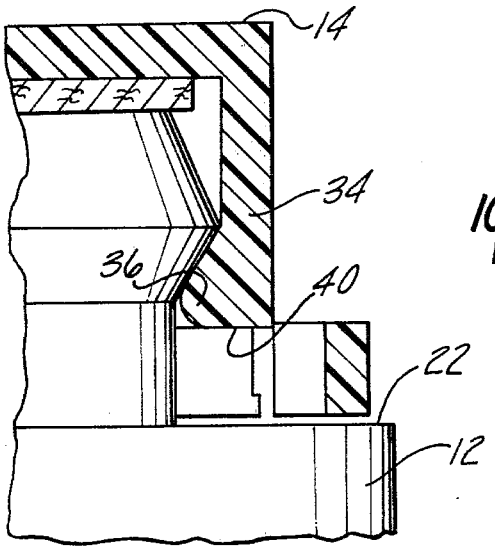
FIG. 6 is a cross-sectional view at an enlarged scale taken on line 6—6 in FIG. 4.
Figure 7:
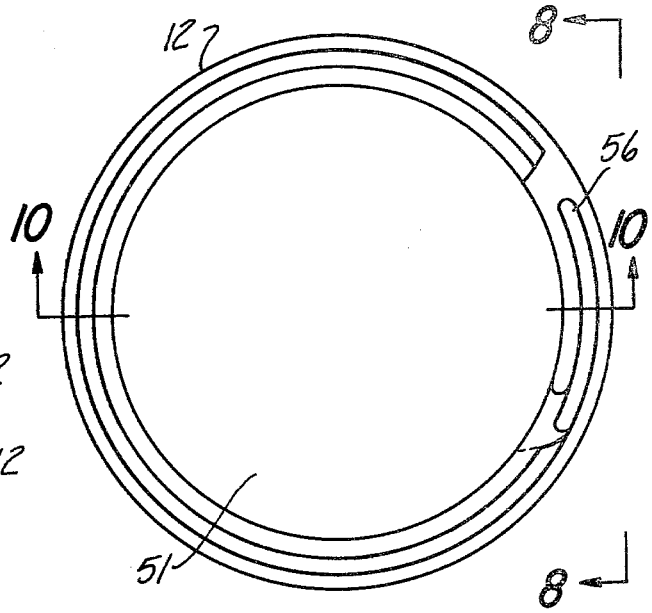
FIG. 7 is a top plan view of another embodiment of the invention.
Figure 8:
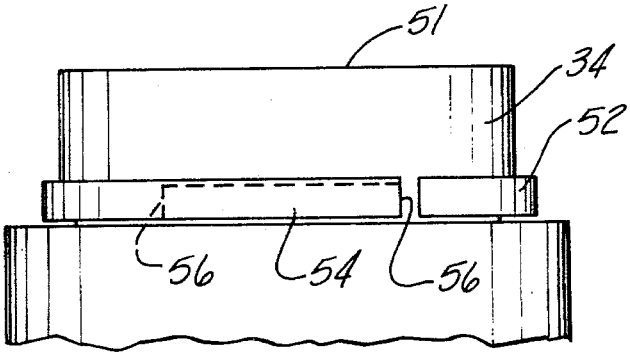
FIG. 8 is a view taken generally on line 8—8 in FIG. 7.
Figure 9:
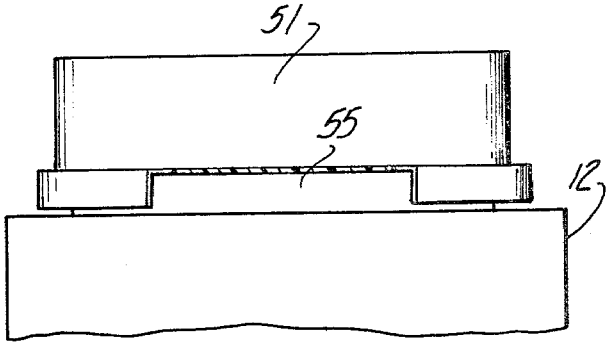
FIG. 9 is a view similar to FIG. 8 but illustrating the package in readiness for opening with a tool.

The neck 18 is provided with annular rib 24 between the lip 20 and the shelf 22. The rib has opposed upper and lower surfaces 26 and 28, respectively. Surfaces 26 and 28 extend radially outwardly to converge at a circumferential line indicated at 30. The cover 14 includes a disc-shaped top portion 32 with a cylindrical flexible skirt 34 terminating in an annular lip 36 which projects radially inwardly and has an inside diameter less than the outside diameter of rib 24. In the closed condition of the package 10, the annular lip 36 of the closure 14 has a surface 37 complementary to and in engagement with the lower surface 28 of the rib 24 on the neck 18 of the container 12. Under that condition and as best seen in FIG. 2, the lip 20 on the neck 18 is closed by a liner 38 held in sealing engagement with the lip 20 to prevent leakage of the contents of the container 12.

Figure 3:
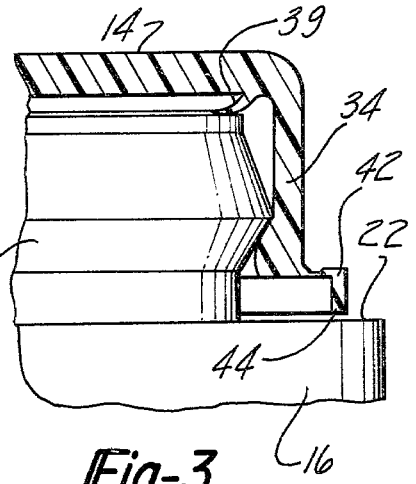
FIG. 3 is a partial cross-sectional view similar to FIG. 2 but showing another form of sealing arrangement for the closure and container.

In FIG. 3 an alternate form of sealing arrangement is shown in which an annular flexible lip seal 39 is molded integrally as a unit with the disk top portion 32. When the closure 14 is in a closed position on the neck 18 the lip seal 39 engages the top or lip 20 on the neck 18 to maintain a flexible fluid tight seal.

It will be noted that the upper surface 26 of the rib 24 is formed at an included angle to the axis of the neck 18 which is less than the included angle of the lower surface 28 relative to the axis of the cylindrical neck 18. This differential in the angle of the surfaces 26 and 28 permits the closure 14 to be attached to the container 12 and moved to a closed position with a minimum of effort. As the closure is moved axially relative to the neck 18 the lip 36 is cammed radially outwardly by the angular surface 26 to deflect skirt 34 until the lip 36 passes the apex formed by the circumferential line 30 between the angular surfaces 26 and 28. As the closure and particularly the annular lip 26 passes the circumferential line 30 the skirt 34 contracts and brings the surface 37 of the annular lip 36 into engagement with the steeper lower surface 28. Such closing movement typically produces an audible snapping sound. Once the surface 28 is engaged with the complementry surface of the annular lip 36, the relatively steeper angle resists removal of the closure 14 except with the use of a tool. It will be understood that the degree of difficulty of opening is determined by the size of the angle of surface 28.

In the closed condition of the container, the bottom edge 40 of the annular lip 36 on the skirt 34 is in a predetermined spaced relationship from the shelf 12 on the on the container 12. The purpose of the spacing is to receive a tool by which the closure 14 can be pried relative to the shelf 22 to displace the closure 14 axially upwardly over the rib 24 and open the container 12.

The space below edge 40 is concealed and obstructed by an annular ring 42 which is formed integrally or as a unit with the closure 14. The ring 42 has its lower annular edge 44 in close proximity to the shelf 22 so that a tool cannot be inserted. The ring 42 also is joined to the remainder of the closure 14 by a thin web 46 forming a line of weakening or frangible portion between the skirt 34 and the radially outwardly disposed ring 42. A tab 48 is provided and also is formed integrally with the closure 14. The tab 48 can be pulled to fracture the line of weakening for the purpose of removing and discarding the ring 42. In the removed condition, the entire annular lip 36 and the space between edge 40 and shelf 22 is exposed for the insertion of a prying tool for the removal of the closure 14 from the container 12. Also in the removed condition of the ring 42 the exposed tool receiving area makes it apparent that the package has been tampered with, that is, it has been placed in a condition for opening and possibly has been opened.

Figure 10:
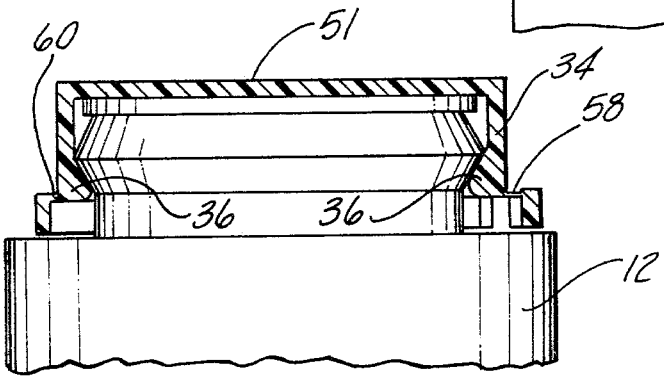
FIG. 10 is a cross-sectional view of the embodiment seen in FIG. 7.

In the embodiment disclosed in FIGS. 1, 2 and 4 through 6, the entire ring 42 is separated from the skirt 34 by the line of weakening formed by web 46. Still another embodiment fo the invention is disclosed in FIGS. 7 through 10 which is the same in many respects to the first embodiment of the invention, except that a closure 51 is provided with a ring 52 formed integrally with the skirt 34 of the closure 51 and only a segment 54 is removable to expose only a circumferential portion of a space 55 between the annular lip 36 and the shelf or shoulder 22. Opposite ends of the segment 54 are provided with pull tabs 56 and the segment is separated from the skirt 34 by an integral web or line of weakening 58. The remainder of the ring 52 is formed integrally with the closure 14 by web 60 having a thicker cross-section as indicated in FIG. 10. To open the package disclosed in FIG. 7 through 10, only the segment 54 is removed exposing a portion of a space 55 which will receive a tool to allow the closure 51 to be pried from the container. In the closed and sealed condition of the package 10 the closure 51 can be rotated in its closed position to any circumferential position relative to the shelf 22.

In both embodiments of the invention, the ring 42 or 52 are maintained in radially spaced relationship to the neck 18 of the container 12, although the annular edge 44 is maintained in close proximity to the shoulder 22 on the container 12, although the annular edge 44 is maintained in close proximity to the shoulder 22 on the container 12. In the first embodiment of the invention disclosed in FIGS. 1 through 6, the entire annular space under edge 40 is exposed for insertion of a tool once the ring 42 is removed. In the second embodiment of the invention disclosed in FIGS. 7 through 10, however, the removal of the segment 54 exposes only a segment of the groove. In both embodiments, the removal of the entire ring 42 or the segment 54 of the ring 52 makes it apparent that the container has at least been placed in a condition by which it could have been opened.

In both embodiments of the invention, once the closure 14 or 51 has been removed and all or a portion of the contents have been removed from the container 12, the closure 14 can be replaced on the container by pushing axially downwardly so that the angular lip 36 engages the upper surface 26 of the rib 24 on the neck 18. Downward movement of the closures 14 and 51 serves to cam the skirt 34 radially outwardly until the angular lip 36 clears the lip 20 by passing the circumferential line 30. Thereafter, additional axial movement of the closure 14 serves to bring the lower surface 28 of the rib 24 into engagement with the complementary surface 37 of the angular lip 36. The interaction of the rib 24 and the lip 36 causes the liner 38 to be pressed into sealing engagement with the lip 20 on the neck 18 to form a seal preventing escape of the contents from the container 12.

The embodiments of the invention in which an exclusive property or privlige is claimed are defined as follows:

1. A child-resistant, tamper indicating package comprising:

a hollow container having a body portion and a tubular neck extending from said body and forming an annular shoulder at the juncture of said body and neck, said neck forming an opening communicating with said container, an annular rib formed on the exterior of said neck and having opposed upper and lower surfaces, a closure having a disc portion for engaging and closing the opening in said neck and a cylindrical flexible skirt extending from said disc portion, said skirt terminating in a lip axially spaced from said shoulder a predetermined distance when said cap is in a closed position to receive a tool for prying said cap from said container, an annular flange formed within said cap on said skirt adjacent to said lip and having an inside diameter less than the outside diameter of said rib, said flange having a surface engageable with the lower surface of said rib to hold said cap in sealing engagement on said neck and resist removal of said cap, said flange being engageable with said upper surface of said rib to deflect said flexible skirt during closing movement of said cap axially on said neck, an annular ring formed as a unit with said skirt and having a lower edge extending axially into close proximity to said shoulder to prevent insertion of a tool and to conceal the tool receiving space between said lip and said shoulder, and a line of weakening between said ring and said skirt permitting removal of at least a portion of said ring and access to said tool receiving space.

2. The child-resistant container of claim 1 wherein said opposed upper and lower surfaces extend radially outwardly from said neck and converge relative to each other.

3. The child-resistant package of claim 1 wherein said annular ring has an inside diameter larger than the diameter of said annular rib.

4. The child-resistant package of claim 2 wherein the included angle of the lower surface of said annular rib with the axis of said neck is greater than the included angle of the upper surface of said rib with the axis of said neck to make removal of said cap to open said neck more difficult than closing of said neck.

5. The child-resistant package of claim 1 wherein a portion of said ring is removable to expose a tool inserting space.

6. The child-resistant container of claim 1 wherein said entire ring is removable to expose the entire annular lip and adjacent shelf for receiving a tool at any selected circumferential location.

7. The child-resistant package of claim 1 wherein said ring is disposed radially inwardly of the outer perimeter of said body portion.

8. The child-resistant container of claim 1 and further comprising a seal associated with said disc for engaging the neck and sealing said opening.

9. The child-resistant package of claim 8 wherein said seal is a flexible annular element formed unitarily with said disc and being flexible relative thereto.

10. The child-resistant container of claim 1 wherein said ring is attached to said closure independently of any portion of said container.

11. The child-resistant package according to claim 1 wherein said ring is removable independently of removal or movement of said closure relative to said container.

12. The child-resistant package of claim 1 in which said ring is spaced radially outwardly from said tool receiving space to form a barrier in radially spaced relationship to the tool receiving space.

* * * * *